US009228594B2

(12) United States Patent
Yu et al.

(10) Patent No.: US 9,228,594 B2
(45) Date of Patent: Jan. 5, 2016

(54) FAN ASSEMBLY AND AIRFLOW PASSAGE STRUCTURE THEREOF

(75) Inventors: Po-Hao Yu, Taoyuan Hsien (TW); Shir-Harn Yeh, Taoyuan Hsien (TW); Yi-Ming Wu, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 877 days.

(21) Appl. No.: 13/301,408

(22) Filed: Nov. 21, 2011

(65) Prior Publication Data

US 2012/0128485 A1 May 24, 2012

(30) Foreign Application Priority Data

Nov. 22, 2010 (TW) ..... 099140190 A

(51) Int. Cl.
*F04D 29/54* (2006.01)
*F01D 25/24* (2006.01)

(52) U.S. Cl.
CPC ..... *F04D 29/541* (2013.01); *F01D 25/24* (2013.01); *F05D 2210/40* (2013.01)

(58) Field of Classification Search
CPC .... F01D 25/24; F05D 2210/40; F04D 29/541
USPC ..... 415/182.1, 202, 208.1, 219.1, 220, 221, 415/222; 361/695, 696, 697
See application file for complete search history.

(56) References Cited

U.S. PATENT DOCUMENTS

| | | | | |
|---|---|---|---|---|
| 2,123,657 | A * | 7/1938 | Munk | 415/220 |
| 4,859,140 | A * | 8/1989 | Passadore | 415/48 |
| 7,014,420 | B2 * | 3/2006 | Chang | 415/121.2 |
| 2006/0039110 | A1 * | 2/2006 | Foster et al. | 361/697 |
| 2008/0124232 | A1 | 5/2008 | Lee et al. | |
| 2008/0260517 | A1 * | 10/2008 | Hayashigaito et al. | 415/68 |
| 2011/0255239 | A1 * | 10/2011 | Franz | 361/679.48 |

FOREIGN PATENT DOCUMENTS

| | | |
|---|---|---|
| DE | 3242185 | 5/1984 |
| TW | 200540340 | 8/2007 |
| TW | 200908859 | 2/2009 |
| TW | M358219 | 6/2009 |

* cited by examiner

*Primary Examiner* — Richard Edgar
*Assistant Examiner* — Juang G Flores
(74) *Attorney, Agent, or Firm* — Kirton McConkie; Evan R. Witt

(57) ABSTRACT

An airflow passage structure is applied to a fan. The airflow passage structure includes a sidewall and an airflow channel. The sidewall has uneven thickness. The airflow channel is defined by an inner surface of the sidewall, and includes a channel entrance and a channel exit. The channel exit is in communication with an airflow inlet of the fan. The diameter of the airflow channel is non-uniformly distributed.

17 Claims, 7 Drawing Sheets

FAN ASSEMBLY AND AIRFLOW PASSAGE STRUCTURE THEREOF

FIELD OF THE INVENTION

The present invention relates to a fan assembly and an airflow passage structure, and more particularly to a fan assembly and an airflow passage structure for reducing noise and enhancing performance.

BACKGROUND OF THE INVENTION

Generally, in view of some reasons (e.g. safety), an additional airflow passage structure is extended from a small-size fan. FIG. 1 is a schematic cross-sectional view illustrating a fan assembly according to the prior art. As shown in FIG. 1, the fan assembly 1 comprises an airflow passage structure 10 and a fan 11. The airflow passage structure 10 is substantially a straight tube-shaped structure with a uniform internal diameter D. An airflow channel is defined by the inner surface 101 of the airflow passage structure 10. The airflow passage structure 10 is installed at an airflow inlet 110 of a fan 11. The use of the airflow passage structure 10 may change the characteristics of the fan, comply with the layout size of the fan or increase the safety of the fan.

Since the direction of the airflow entering the airflow channel of the airflow passage structure 10 is not completely parallel with the inner surface 101 of the airflow passage structure 10, a portion of the airflow possibly stagnates within the airflow channel. That is, since some stagnation zones are possibly formed in the vicinity of the inner surface 101 of the airflow passage structure 10, a portion of the airflow whirls within the airflow channel. Under this circumstance, the performance of the fan is deteriorated, and the noise resulted from the fan is increased.

SUMMARY OF THE INVENTION

The present invention provides a fan assembly and an airflow passage structure for obviating the drawbacks encountered from the prior art, reducing noise and enhancing performance.

In accordance with an aspect of the present invention, there is provided an airflow passage structure for use with a fan. The airflow passage structure includes a sidewall and an airflow channel. The sidewall has uneven thickness. The airflow channel is defined by an inner surface of the sidewall, and includes a channel entrance and a channel exit. The channel exit is in communication with an airflow inlet of the fan. The diameter of the airflow channel is non-uniformly distributed due to the uneven thickness of the sidewall. Preferably, from the channel entrance to the channel exit, the diameter of the airflow channel gradually decreases and then gradually increases.

In accordance with another aspect of the present invention, there is provided a fan assembly. The fan assembly includes a fan and an airflow passage structure. The fan has an airflow inlet. The airflow passage structure includes a sidewall for defining an airflow channel. The airflow channel includes a channel entrance and a channel exit. The channel exit is in communication with the airflow inlet of the fan. The thickness of the sidewall is uneven so that the diameter of the airflow channel is non-uniformly distributed. Preferably, from the channel entrance to the channel exit, the diameter of the airflow channel gradually decreases and then gradually increases.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 2A:
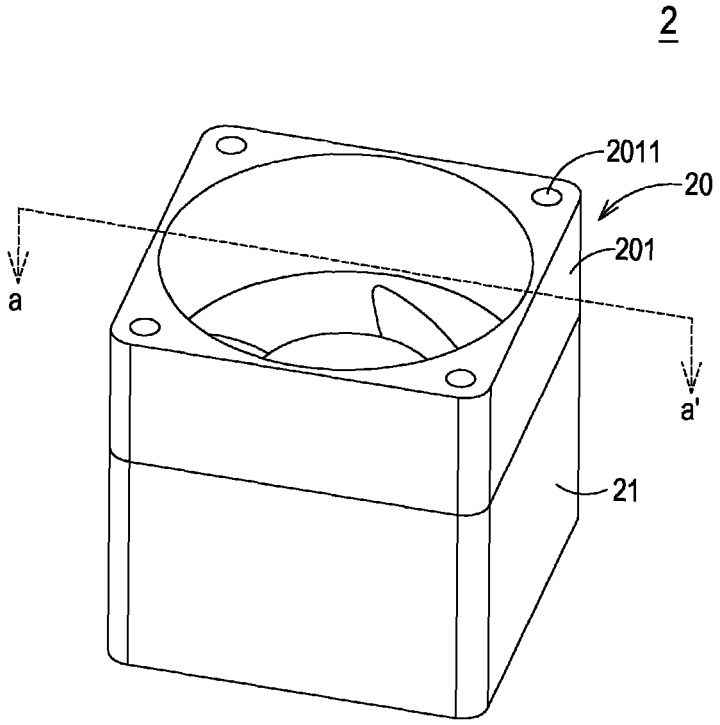
FIG. 2A is a schematic perspective view illustrating a fan assembly according to a first embodiment of the present invention.
Figure 2B:
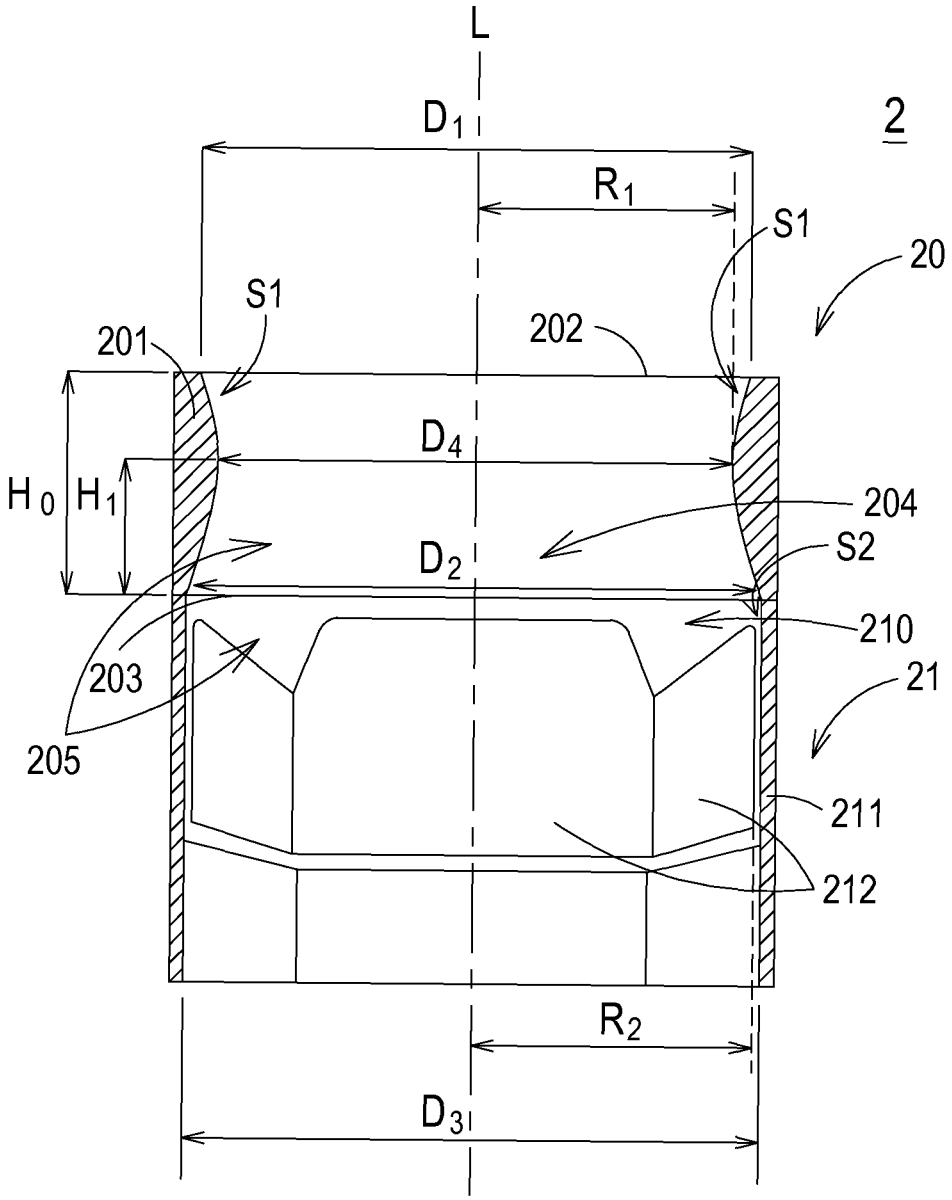
FIG. 2B is a schematic cross-sectional view illustrating the fan assembly as shown in FIG. 2A and taken along the line a-a'.

FIG. 2A is a schematic perspective view illustrating a fan assembly according to a first embodiment of the present invention. FIG. 2B is a schematic cross-sectional view illustrating the fan assembly as shown in FIG. 2A and taken along the line a-a'. As shown in FIGS. 2A and 2B, the fan assembly 2 comprises an airflow passage structure 20 and a fan 21. The airflow passage structure 20 comprises a sidewall 201 and plural fixing parts 2011. The fixing parts 2011 are disposed on the sidewall 201. Via the fixing parts 2011, the airflow passage structure 20 can be installed on the fan 21. For example, the fixing parts 2011 are fixing holes. By penetrating screws through corresponding fixing holes, the airflow passage structure 20 is fixed on the fan 21. Alternatively, the airflow passage structure 20 may be fixed on the fan 21 by other connecting means such as adhering or fastening means. The fan 21 has a frame 211 and a blade 212. In this embodiment, the airflow passage structure 20 is a hollow structure. An airflow channel 204 is defined by an inner surface S1 of the sidewall 201. The airflow channel 204 has a channel entrance 202 and a channel exit 203. The channel exit 203 is in communication with an airflow inlet 210 of the fan 21. The sidewall 201 is in connection with the frame 211 of the fan 21. The frame 211 has an inner surface S2, and a continuous and integrated passage 205 is formed by the inner surface S1 of the sidewall 201 and the inner surface S2 of the frame 211. The blade 212 is disposed in the continuous and integrated passage 205. In accordance with a key feature of the present invention, the thickness of the sidewall 201 is uneven so that the diameter of the airflow channel 204 is non-uniformly distributed. From the channel entrance 202 to the channel exit 203, the diameter of the airflow channel 204 gradually decreases and then gradually increases. In other words, the airflow channel 204 is sandglass-shaped. In this embodiment, the diameter of the airflow channel 204 at the channel entrance 202 is D1, the diameter of the airflow channel 204 at the channel exit 203 is D2, and the inner diameter of the frame 211 of the fan 21 is D3. In this embodiment, the inner surface S1 of the sidewall 201 is arc-shaped. Corresponding to the thickest portion of the sidewall 201, the narrowest portion of the airflow channel 204 has the diameter D4. In such way, the diameter of the airflow channel 204 gradually decreases and then gradually increases from the channel entrance 202 to the channel exit 203. In this embodiment, the channel entrance 202 is closer to the narrowest portion of the airflow channel 204 than the channel exit 203. Each of the diameter D1 of the channel entrance 202 and the diameter D2 of the channel exit 203 is greater than the narrowest diameter D4. In this embodiment, a central axis L is passing through the center of the airflow passage structure 20 and the center of the fan 21. The radius R1 is defined from the center of the airflow passage structure 20 to the narrowest portion of the airflow channel 204. The radius R2 is defined from the center of the fan 21 to the edge of the blade 212 along a radial direction. Preferably, the radius R1 of said airflow channel at the narrowest portion is less than the radius R2 defined from the center of the fan 21 to the edge of the blade 212 along a radial direction.

The length of the airflow passage structure 20 is H0. That is, the distance between the channel entrance 202 and the channel exit 203 is H0. In addition, the distance between the narrowest portion of the airflow channel 204 (with the narrowest diameter D4) and the channel exit 203 is H1.

In accordance with the present invention, the relationships between the diameters D1, D2 and D4 and the relationship between the distances H0 and H1 comply with the following formulae: $0.95\times D1>D4>0.6\times D1$, $0.95\times D2>D4>0.6\times D2$, and $0.8\times H0>H1>0.35\times H0$. That is, the ratio of the narrowest diameter D4 of the airflow channel 204 to the diameter D1 of the channel entrance 202 is ranged from 0.6 to 0.95; and the ratio of the narrowest diameter D4 of the airflow channel 204 to the diameter D2 of the channel exit 203 is ranged from 0.6 to 0.95. Moreover, the ratio of the distance H1 between the narrowest portion of the airflow channel 204 and the channel exit 203 to the distance H0 between the channel entrance 202 and the channel exit 203 is ranged from 0.35 to 0.80. In such way, the use of the airflow passage structure 20 can reduce the noise of the fan 21 and enhance the performance of the fan 21. After the fan 21 is enabled, the airflow is fed into the airflow channel 204 through the channel entrance 202, and then inhaled by the fan 21 through the channel exit 203. Since the airflow channel 204 is sandglass-shaped, the possibility of causing the stagnation zones of the airflow within the airflow channel 204 will be minimized. Under this circumstance, the noise resulted from the fan is largely reduced and the performance of the fan is enhanced.

Figure 3:
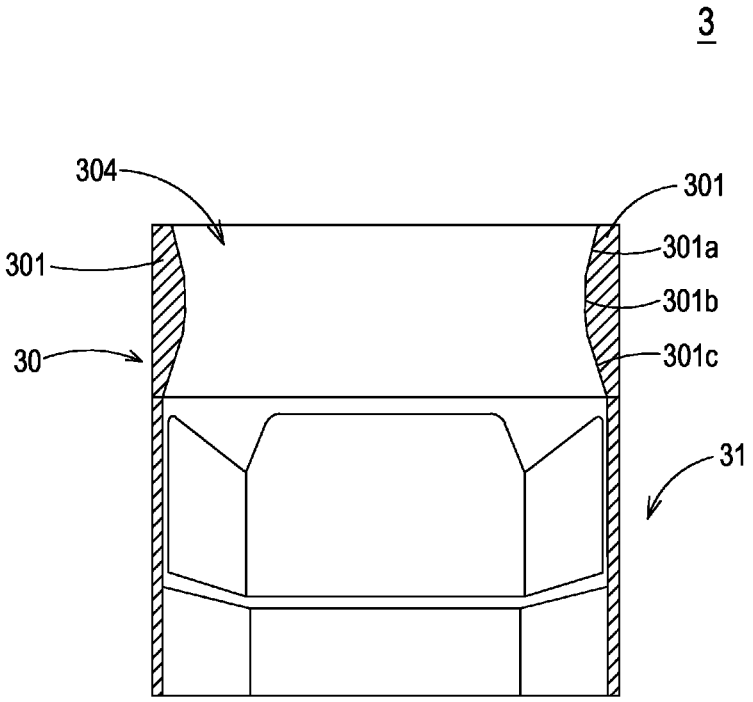
FIG. 3 is a schematic cross-sectional view illustrating a fan assembly according to a second embodiment of the present invention.

FIG. 3 is a schematic cross-sectional view illustrating a fan assembly according to a second embodiment of the present invention. As shown in FIG. 3, the fan assembly 3 comprises an airflow passage structure 30 and a fan 31. The configurations and the functions of the fan 31 are similar to those of the fan 21 of the first embodiment, and are not redundantly described herein. In this embodiment, the sidewall 301 of the airflow passage structure 30 comprises a first segment 301*a*, a second segment 301*b* and a third segment 301*c*. In this embodiment, the first segment 301*a* and the third segment 301*c* have the shapes of hollow cones. The second segment 301*b* is arranged between the first segment 301*a* and the third segment 301*c*, and has a shape of a hollow cylinder. In other words, the airflow channel 304 is also sandglass-shaped. Consequently, the possibility of causing the stagnation zones of the airflow within the airflow channel 304 is minimized, and the noise resulted from the fan is largely reduced.

Figure 1:
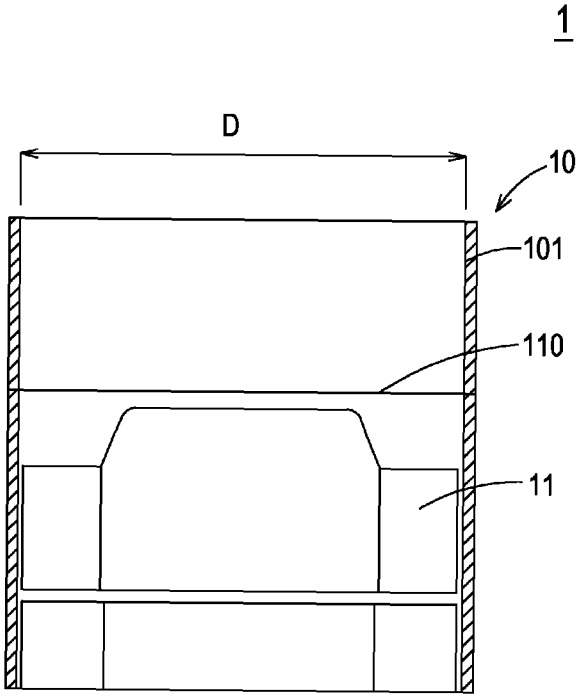
FIG. 1 PRIOR ART
FIG. 1 is a schematic cross-sectional view illustrating a fan assembly according to the prior art.
Figure 4:
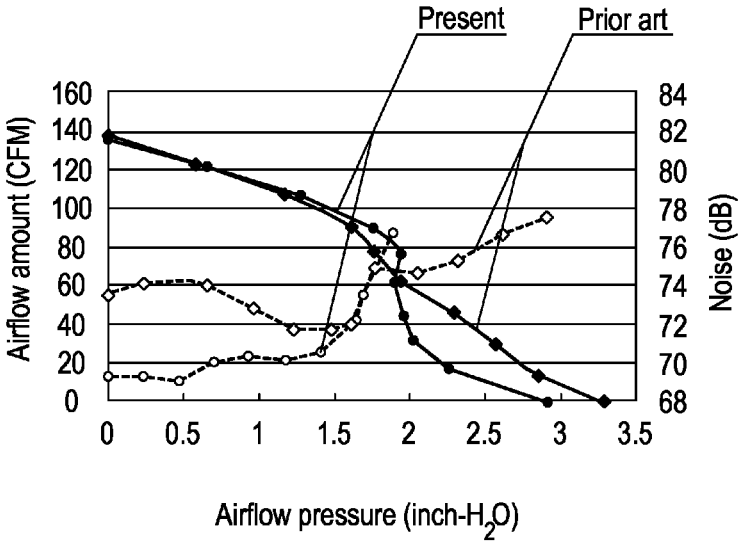
FIG. 4 is a schematic plot illustrating the relationship between the airflow amount, the airflow pressure and the noise (dB) of the fan assembly of FIG. 2A in comparison with the fan assembly of FIG. 1.

FIG. 4 is a schematic plot illustrating the relationship between the airflow amount, the airflow pressure and the noise (dB) of the fan assembly of FIG. 2A in comparison with the fan assembly of FIG. 1. The solid curves indicate the relationships between the airflow amount and the airflow pressure of the fan assembly 2 of the present invention and the conventional fan assembly 1. The dashed curves indicate the relationships between the airflow pressure and the noise of the fan assembly 2 of the present invention and the conventional fan assembly 1. Assuming that the airflow pressure is 0.5 inch-$H_2O$, the noise generation of the fan assembly 2 is obviously lower than the noise generation of the conventional fan assembly 1. That is, the noise resulted from the fan assembly 2 of the present invention is effectively reduced.

Figure 5:
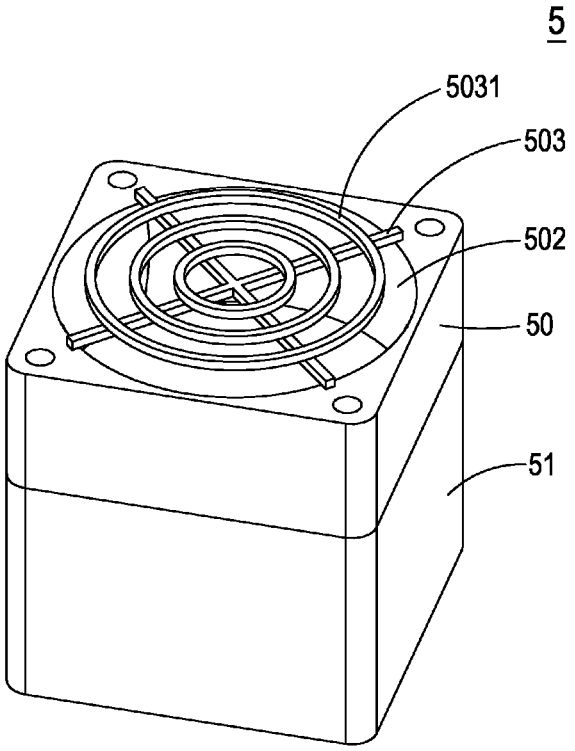
FIG. 5 is a schematic cross-sectional view illustrating a fan assembly according to a third embodiment of the present invention.

FIG. 5 is a schematic cross-sectional view illustrating a fan assembly according to a third embodiment of the present invention. As shown in FIG. 5, the fan assembly 5 comprises an airflow passage structure 50 and a fan 51. The configurations and the functions of the fan 51 are similar to those of the fan of FIGS. 2A and 3, and are not redundantly described herein. In this embodiment, the airflow passage structure 50 further comprises a covering member 503, which is arranged at the channel entrance 502. The covering member 503 is integrally formed, and made of plastic or metallic material. In this embodiment, the covering member 503 is a grating structure with plural slices 5031. In this embodiment, the slices 5031 are concentric and have rectangular cross sections.

Figure 6:
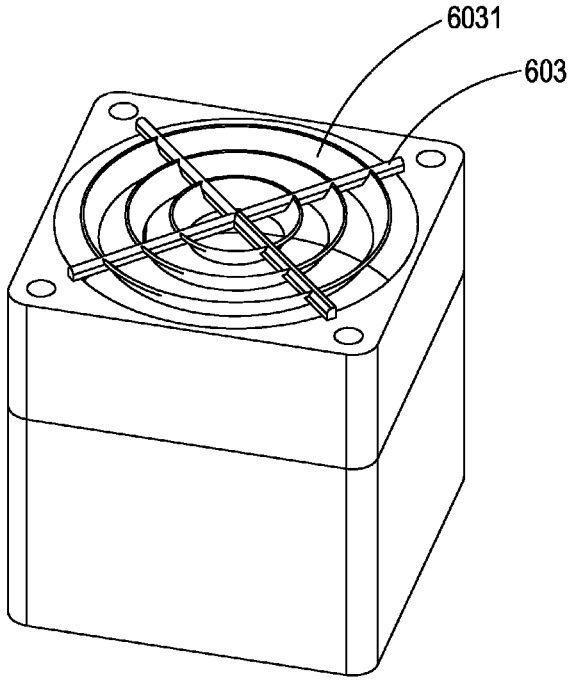
FIG. 6 is a schematic cross-sectional view illustrating a fan assembly according to a fourth embodiment of the present invention.

It is noted that the numerous modifications of the covering member can be made while retaining the teachings of the invention. FIG. 6 is a schematic cross-sectional view illustrating a fan assembly according to a fourth embodiment of the present invention. In comparison with FIG. 5, the covering member of the airflow passage structure is distinguished. As shown in FIG. 6, the covering member 603 is a grating structure with plural concentric slices 6031. The slices 6031 have streamline-shaped cross sections. Alternatively, the slices 6031 of the covering member 603 may have arbitrary shapes (e.g. curvy shape or stationary blade shape) cross sections. The use of the covering member can prevent foreign article from entering the airflow inlet of the fan, thereby increasing the safety of the fan.

From the above description, the present invention provides a fan assembly and an airflow passage structure. An airflow channel is defined by an inner surface of a sidewall of the airflow passage structure. Since the diameter of the airflow channel gradually decreases and then gradually increases, the airflow channel is sandglass-shaped. Due to the sandglass-shaped airflow channel, the possibility of causing the stagnation zones of the airflow within the airflow channel will be minimized. Under this circumstance, the noise resulted from the fan is largely reduced and the performance of the fan is enhanced. Moreover, the airflow passage structure may further comprise a covering member at the channel entrance. The use of the covering member can prevent foreign article from entering the airflow inlet of the fan, thereby increasing the safety of the fan.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An airflow passage structure for use with a fan, wherein said fan has a blade and a frame having an airflow inlet, said airflow passage structure comprising:

a sidewall having an uneven thickness; and an airflow channel defined by an inner surface of said sidewall, and comprising a channel entrance and a channel exit, wherein said sidewall is in connection with said frame of said fan, a continuous and integrated passage is formed by said inner surface of said sidewall and an inner surface of said frame of said fan, said blade is disposed in said continuous and integrated passage, said channel exit is in communication with said airflow inlet of said fan, and the diameter of said airflow channel is non-uniformly distributed, wherein the thickness of each portion of said inner surface of said sidewall is greater than the thickness of said inner surface of said frame, the thickness of said inner surface of said frame is a constant, said airflow channel has a narrowest portion located at a thickest portion of said sidewall, said channel entrance is closer to said narrowest portion of said airflow channel than said channel exit, each of the diameter of said channel entrance and the diameter of said channel exit is greater than the diameter of said narrowest portion of said airflow channel, and a radius of said airflow channel at said narrowest portion is less than a radius defined from a center of said fan to an edge of said blade along a radial direction.

2. The airflow passage structure according to claim 1, wherein from said channel entrance to said channel exit, the diameter of said airflow channel gradually decreases and then gradually increases.

3. The airflow passage structure according to claim 1, wherein said airflow passage structure is a hollow structure.

4. The airflow passage structure according to claim 1, wherein said inner surface of said sidewall is arc-shaped.

5. The airflow passage structure according to claim 1, wherein said sidewall comprises a first segment, a second segment and a third segment, wherein said first segment and said third segment have the shapes of hollow cones, wherein said second segment is arranged between said first segment and said third segment and has a shape of a hollow cylinder.

6. The airflow passage structure according to claim 1, wherein a ratio of the diameter of said narrowest portion to the diameter of said channel entrance is ranged from 0.6 to 0.95.

7. The airflow passage structure according to claim 1, wherein a ratio of the diameter of said narrowest portion to the diameter of said channel exit is ranged from 0.6 to 0.95.

8. The airflow passage structure according to claim 1, wherein a ratio of the distance between said narrowest portion and said channel exit to the distance between said channel entrance and said channel exit is ranged from 0.35 to 0.80.

9. The airflow passage structure according to claim 1, wherein said airflow passage structure further comprises plural fixing parts, which are disposed on said sidewall, wherein said airflow passage structure is installed on said fan through said fixing parts.

10. The airflow passage structure according to claim 9, wherein said airflow passage structure is installed on said fan by screwing, adhering or fastening means.

11. A fan assembly, comprising:

a fan having a blade and a frame, wherein said frame has an airflow inlet; and an airflow passage structure comprising a sidewall for defining an airflow channel, wherein said airflow channel comprises a channel entrance and a channel exit, said sidewall is in connection with said frame of said fan, a continuous and integrated passage is formed by said inner surface of said sidewall and an inner surface of said frame of said fan, said blade is disposed in said continuous and integrated passage, and said channel exit is in communication with said airflow inlet of said fan, wherein said sidewall has an uneven thickness so that the diameter of said airflow channel is non-uniformly distributed, the thickness of each portion of said inner surface of said sidewall is greater than the thickness of said inner surface of said frame, and the thickness of said inner surface of said frame is a constant, wherein said airflow channel has a narrowest portion located at a thickest portion of said sidewall, said channel entrance is closer to said narrowest portion of said airflow channel than said channel exit, each of the diameter of said channel entrance and the diameter of said channel exit is greater than the diameter of said narrowest portion of said airflow channel, and a radius of said airflow channel at said narrowest portion is less than a radius defined from a center of said fan to an edge of said blade along a radial direction.

12. The fan assembly according to claim 11, wherein said airflow passage structure further comprises a covering member, which is arranged at said channel entrance.

13. The fan assembly according to claim 12, wherein said covering member is a grating structure with plural concentric slices, wherein said slices has rectangular, streamline-shaped, curvy shape or stationary blade shape cross sections.

14. The fan assembly according to claim 12, wherein said covering member is integrally formed, and made of plastic or metallic material.

15. The fan assembly according to claim 11, wherein from said channel entrance to said channel exit, the diameter of said airflow channel gradually decreases and then gradually increases.

16. The fan assembly according to claim 11, wherein said sidewall has an arc-shaped inner surface.

17. The fan assembly according to claim 11, wherein said sidewall comprises a first segment, a second segment and a third segment, wherein said first segment and said third segment have the shapes of hollow cones, wherein said second segment is arranged between said first segment and said third segment and has a shape of a hollow cylinder.

* * * * *